United States Patent [19]

Kennedy

[11] Patent Number: 4,742,691

[45] Date of Patent: May 10, 1988

[54] DEHUMIDIFIER

[75] Inventor: Robert W. Kennedy, Bridgewater Township, Somerset County, N.J.

[73] Assignee: White Consolidated Industries, Inc., Cleveland, Ohio

[21] Appl. No.: 869,418

[22] Filed: Jun. 2, 1986

[51] Int. Cl.[4] ..... F25D 23/12

[52] U.S. Cl. ..... 62/272; 62/150

[58] Field of Search ..... 62/272, 150, 271, 273, 62/274, 92

[56] References Cited

U.S. PATENT DOCUMENTS

| | | | |
|---|---|---|---|
| 2,115,527 | 4/1938 | Hueglin | 230/273 |
| 2,558,541 | 6/1951 | Cotten | 248/16 |
| 2,648,202 | 8/1953 | Otterholm | 62/272 |
| 2,710,509 | 6/1955 | Ayling | 62/140 |
| 2,759,335 | 8/1956 | Weschler, Jr. | 62/4 |
| 2,779,173 | 1/1957 | Wurtz | 62/140 |
| 2,811,842 | 11/1957 | Taylor | 62/140 |
| 2,867,993 | 1/1959 | Morton et al. | 62/297 |
| 2,956,417 | 10/1960 | Lyman | 62/150 |
| 2,974,500 | 3/1961 | Sholtes | 62/428 |
| 3,110,161 | 11/1963 | Maleck | 62/188 |
| 3,258,932 | 7/1966 | Kern | 62/93 |
| 3,317,124 | 5/1967 | Morrill | 230/273 |
| 3,496,731 | 2/1970 | Sholtes | 62/173 |
| 3,500,654 | 3/1970 | Sholtes | 62/150 |
| 3,508,729 | 4/1970 | Wilson | 248/26 |
| 3,699,873 | 10/1972 | Irvin | 98/116 |
| 3,759,158 | 9/1973 | Henry et al. | 98/33 |
| 4,014,314 | 3/1977 | Newton | 126/271 |
| 4,054,980 | 10/1977 | Roma | 29/157.3 |
| 4,135,370 | 1/1979 | Hosoda et al. | 62/274 |
| 4,151,726 | 5/1979 | Schlueter | 62/285 |
| 4,185,688 | 1/1980 | Wiater et al. | 165/122 |
| 4,191,246 | 3/1980 | Wendt et al. | 165/69 |
| 4,202,409 | 5/1980 | Cann et al. | 165/122 |
| 4,254,311 | 3/1981 | Sisk, Jr. | 200/61.07 |
| 4,287,724 | 9/1981 | Clark | 62/272 |
| 4,321,800 | 3/1982 | Gifford, Jr. | 62/150 |
| 4,394,111 | 7/1983 | Wiese et al. | 417/360 |
| 4,428,207 | 1/1984 | Hall | 62/176.1 |
| 4,475,359 | 10/1984 | Sano | 62/272 |
| 4,502,291 | 3/1985 | Shelton et al. | 62/285 |
| 4,554,794 | 11/1985 | Khan | 62/150 |

FOREIGN PATENT DOCUMENTS

| | | | |
|---|---|---|---|
| 124129 | 7/1983 | Japan | 62/150 |

*Primary Examiner*—Henry A. Bennet

*Attorney, Agent, or Firm*—Pearne, Gordon, McCoy & Granger

[57] ABSTRACT

A portable dehumidifier of the domestic type includes a one piece, vertically extending, plastic frame supporting a condenser/evaporator module, a fan module, and a condensate collecting bucket. The frame, providing an integral air flow duct at its upper end, is supported at its lower end by a metal base plate. The base plate supports a hermetic refrigeration compressor providing refrigerant to the condenser/evaporator module positioned within the duct. The evaporator portion of the condenser/evaporator module is formed from a continuous length of partially flattened tubing spirally wound inwardly and then outwardly to form two adjacent sections of evaporator coil. In a similar manner, the condenser portion of the condenser/evaporator module is formed from a continuous length of finned tubing spirally wound inwardly and then outwardly to form two adjacent sections of condenser coil. A plastic cage holds the condenser and evaporator coils in position within the air duct, and also maintains the evaporator and condenser coils in adjacent position relative to each other during assembly of the dehumidifier.

25 Claims, 6 Drawing Sheets

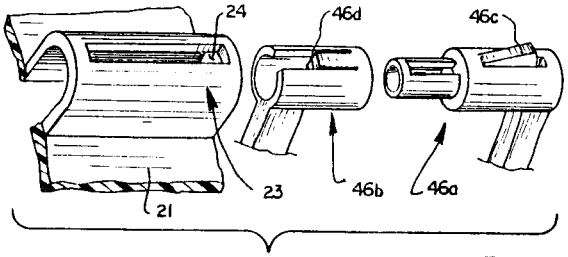
FIG.7
FIG.8
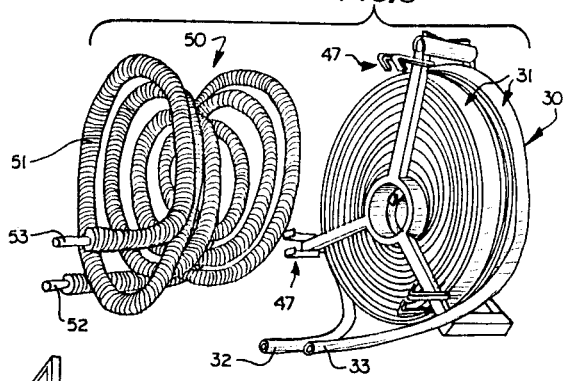
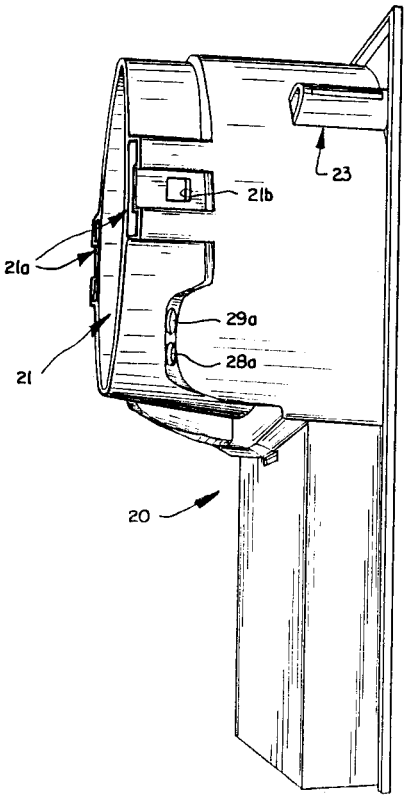
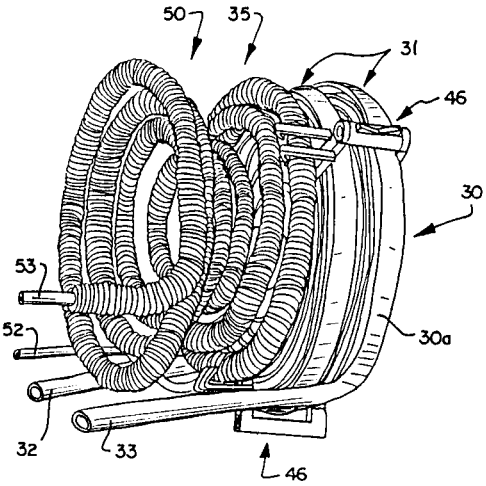
FIG.9

DEHUMIDIFIER

BACKGROUND OF THE INVENTION

The present invention relates in general to air conditioning devices, and more particularly to a portable dehumidifier of the domestic or household type having a removable bucket for the disposal of accumulated condensate. Such dehumidifiers are well known in the art as illustrated by U.S. Pat. Nos. 2,956,417; 3,496,731; and 3,500,654; all owned by the assignee of the present invention, and incorporated by reference herein in their entireties.

Such prior art dehumidifiers include a wheel supported, horizontal base member on which is mounted a small hermetic motor-compressor refrigeration unit. One or more multipart frame members extend upwardly from the base member to support an evaporator coil connected in series with a condenser coil via a capillary tube functioning as an expansion valve, the evaporator coil being provided with cold refrigerant by the refrigeration unit. A motor-driven fan induces air flow through the dehumidifier, the air flowing over the cold evaporator coil for dehumidification, the dehumidified air then flowing over the condenser coil to cool it. Condensate accumulates on the evaporator coil, and then drips into a bucket, which typically is associated with a float actuated switch mechanism for deactivating the dehumidifier to preclude overfilling of the condensate collecting bucket.

In manufacturing and assembling a dehumidifier of the subject type, numerous problems can arise. For example, since the dehumidifier is portable, it is often moved about and jostled during normal use. Also, during operation, the motor-compressor unit can induce vibrations in components of the dehumidifier resulting in unacceptable noise levels during operation. Further, the noted movements and vibrations can sometimes cause failure of the fluid coupling joints in the closed refrigeration system including the refrigeration unit, evaporator coil, and condenser coil, thus resulting in a loss of refrigerant. Further, such movements and vibrations can cause the mountings of the dehumidifier components to loosen or fatigue wherein components, such as the earlier noted motor driven fan, or the evaporator and condenser coils, might break loose thus resulting in failure of the dehumidifier.

While the usual solution to the above-noted problems would be to provide vibration and shock resistant couplings and mountings, the inherent added cost is a serious disadvantage in the highly competitive domestic appliance industry. Preferably, the number of dehumidifier components should be minimal and of a simple design, and the assembly steps of such components should be minimal to provide cost effectiveness.

It is an object of the present invention to provide a highly reliable and rugged portable dehumidifier of low cost due to a design incorporating low cost components easily assembled by non-skilled labor.

SUMMARY OF THE INVENTION

In accordance with the present invention, a portable dehumidifier includes a horizontal base member supporting a frame which provides an air flow duct. A fan module induces air flow through the duct which contains a condenser/evaporator module having a condenser coil, an evaporator coil, and a retaining means engaging both of the coils to hold the coils in position relative to each other during assembly of the dehumidifier. The retaining means includes mounting portions engageable with wall portions of the frame defining the air duct wherein the retaining means also positions and supports the module within the duct. A hermetic refrigeration compressor provides refrigerant to the condenser/evaporator module.

Preferably, the frame is a one piece molded plastic member extending vertically upwardly from the base. The condenser/evaporator module includes a plastic cage for containing sections of the evaporator coil, and for holding the evaporator and condenser together, the cage constituting the noted retaining means for mounting the condenser/evaporator module within the air duct. The cage provides fingerlike members which engage and grip the condenser coil portion of the condenser/evaporator module so that the module, in the form of a subassembly, can be inserted as a unit into the air duct and lockably retained therein during assembly of the dehumidifier.

In further accordance with the invention, the noted fan module constitutes a subassembly including a motor driven fan for inducing the flow of dehumidified air through the duct. The motor driven fan is connected to the base portion of a U-shaped bracket having distal ends in the form of bayonet projections that are easily inserted into sockets in the wall portions of the molded plastic frame defining the air flow duct wherein the fan module is supported solely by a frame.

In further accordance with the invention, the condenser/evaporator module includes a continuous length of refrigeration tubing spirally wound inwardly and then outwardly about and along a common axis to provide a pair of truncated cone-shaped springlike first coil sections with their apex portions abutting each other. The cage contains and maintains under compression the springlike coil sections wherein the coil sections when compressed in the cage are generally disc shaped and are held by the cage in adjacent parallel relation to each other, the spirally wound tubing being held in compression by and within the cage to minimize mechanical vibration of the first coil sections within the cage. The refrigeration coil module can include a second continuous length of refrigeration tubing spirally wound inwardly and then outwardly about said common axis to provide a pair of adjacent second coil sections, the second length of spirally wound tubing being held by hooklike projections of the cage to hold the first and second lengths of spirally wound tubing in adjacent relationship to each other. The first and second lengths of coil tubing can be interconnected by a capillary tube functioning as an expansion valve so as to provide a refrigeration evaporator and a condenser for the dehumidifier.

In further accordance with the invention, the dehumidifier includes an improved float for sensing a rising level of condensate in a condensate collection bucket. The improved float includes a float portion pivotally supported on a portion of the rim of the bucket wherein the rim portion acts as a fulcrum point. A lever arm emanates from the fulcrum point and extends toward and engages an actuating element of an electrical switch wherein the predetermined upward and downward movement of the float portion causes concurrent but opposite downward and upward movements of the distal end of the lever arm to in turn cause the electrical switch to be actuated so as to change from one conducting condition to another conducting condition wherein operation of the dehumidifier is disabled or enabled. Preferably, the float includes a hinge pin portion journalled for pivotal movement on the rim portion of the bucket the float including means for lockably retaining the float in position on the bucket rim when the bucket is removed from the dehumidifier for cleaning or to empty the condensate contained therein.

BRIEF DESCRIPTION OF THE DRAWINGS

A fuller understanding of the invention may be had by referring to the following description and claims taken in conjunction withy the accompanying drawings, wherein:

FIG. 7 is an exploded view of portions of the cage and a frame member of the dehumidifier to illustrate the assembly and mounting of the cage structure within an air duct provided by the frame member;

FIG. 8 is a partially exploded view of a cage-contained evaporator coil prior to its assembly with an associated condenser coil;

FIG. 9 is a side view of a condenser/evaporator module or subassembly as it is about to be inserted into and mounted within a duct portion of the frame of the dehumidifier;

DETAILED DESCRIPTION OF THE PREFERRED EMBODIMENT

Figure 1:
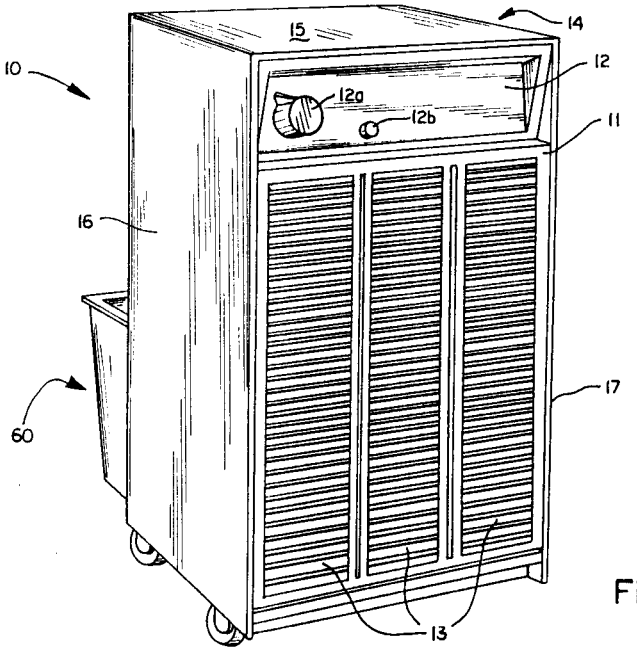
FIG. 1 is a left front perspective view of a dehumidifier in accordance with the present invention.
Figure 2:
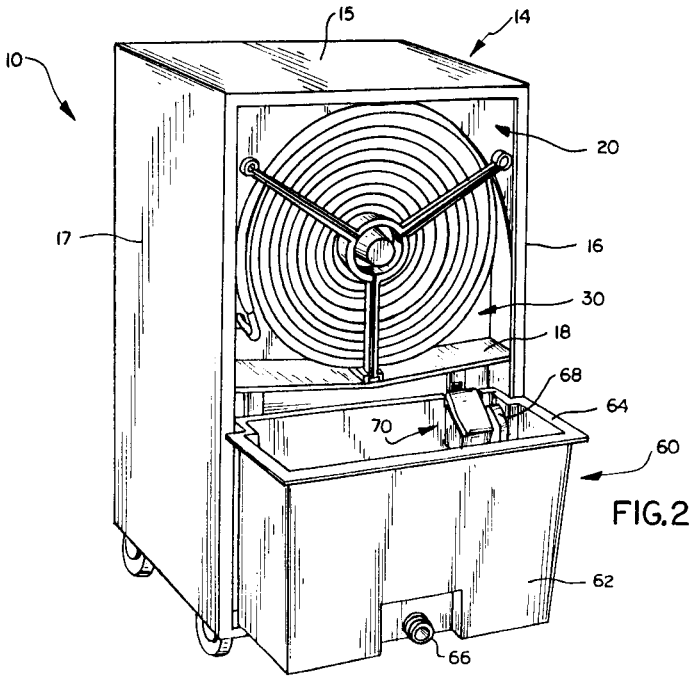
FIG. 2 is a left rear perspective view of the dehumidifier of FIG. 1, wherein a removable condensate collected bucket with a float assembly is more clearly illustrated.

With reference to FIGS. 1 and 2, a portable dehumidifier 10 for domestic or household use is illustrated, the dehumidifier 10 having a front panel 11 preferably formed as an integral unit from injection molded plastic material. The front panel 11 is generally planar and includes a recessed upper control area 12 which presents to the user an adjustable knob 12*a* for regulating operation of the dehumidifier, and a shut off indicator 12*b* preferably in the form of an incandescent lamp which illuminates to alert the user that the dehumidifier has shut itself off due to complete filling of a condensate collecting bucket 60, such atutomatic shut off feature being well known in the art. The front panel 11 further includes, as its major lower portion, a plurality of three vertically extending grill areas or sections 13 that allow air flow through the panel 11. A one piece, sheet metal housing 14 provides a top panel 15 and a pair of opposed side panels 16, 17, the sheet metal housing 14 and the front panel 11 together comprising an outer enclosure for the dehumidifier 10.

With particular reference to FIG. 2, the rear of the dehumidifier 10 can be seen more clearly, the dehumidifier 10 having an evaporator coil 30 which is positioned above the removable condensate collecting bucket 60 preferably formed from injection molded plastic material. The bucket 60 includes a four sided, cubicle body portion 62, and a generally rectangular rim 64 at its upper end. The bottom or lower end of the bucket 60 includes as an integral portion thereof a drain 66 in the form of a threaded nipplelike projection to which can be attached a standard flexible hose so that the condensate bucket 60 can be continuously drained if so desired. It is to be noted that the drain 66 is plugged when automatic draining is not desired as would be the case in many if not most applications. As viewed in FIG. 2, the left and right sidewalls of the bucket 60 are provided at their forward or front end with a pair of bucket mounting recesses 68 (only one shown) which constitute journal or bushing portions for receiving projecting pins or mounting studs 68*a* (only one shown—see FIG. 3).

As will be subsequently discussed in greater detail, a pivotally mounted float 70 supported by a fulcrum functioning portion of the rim 64 of the bucket 60 actuates an electrical switch to turn off the dehumidifier 10 when the level of condensate in the bucket 60 reaches a maximum level requiring emptying of the bucket.

As is well known in the art, with reference to both FIGS. 1 and 2, a motor driven fan (to be subsequently illustrated) draws and induces air flow over the evaporator coil 30 which is chilled by refrigerant flowing through it wherein condensate will form on the evaporator coil 30 and will then drip onto a shelflike gutter or ledge 18 which accumulates and directs the condensate so that it will drip into the collecting bucket 60. After passing over the evaporator coil 30, the now dehumidified air passes over a condenser coil (to be subsequently illustrated) so as to cool it, the dehumidified air then being exhausted from within the dehumidifier 10 outwardly through the grill areas 13 of the front panel 11. The degree of dehumidification is determined by the setting of the knob 12*a* to a desired position. When the condensate level in the bucket 60 reaches a maximum level, the float 70 will have risen to shut off the dehumidifier 10 wherein the user must remove the bucket 62 and empty the condensate from it, and then reinstall the bucket as illustrated in FIG. 2 wherein the dehumidifier 10 can once again operate in a dehumidification mode.

Figure 3:
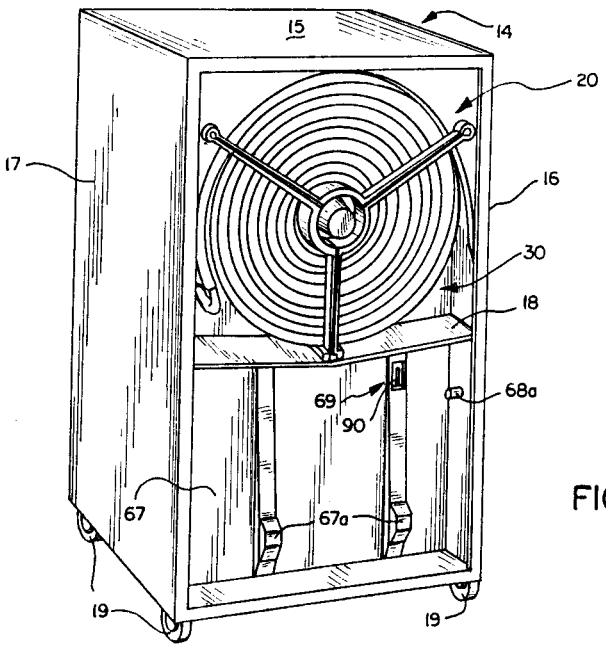
FIG. 3 is a left rear perspective view of the dehumidifier of FIG. 2 wherein the condensate bucket has been removed.

Turning to FIG. 3, a clearer illustration of the mounting area for the bucket 60 is shown. It can be seen that the illustrated stud 68*a* projects from a main frame member 20 to pivotally support the right side of the bucket 60 (see FIG. 2). A similar, but not illustrated, stud supports the left side of the bucket 60 so that the bottom of the bucket 60 can be swung or pivoted outwardly away from a recessed wall 67 of the frame member 20 and then lifted upwardly off of the mounting studs wherein the bucket 60 can be removed for cleaning or emptying at a remote location. A pair of projections 67*a* provided by the wall 67 constitute stops for accurately positioning the bucket 60 so that its rim 64 will lie in a generally horizontal plane as illustrated in FIG. 2.

With further reference to FIG. 3, the wall portion 67 has, at its upper right hand corner as viewed in FIG. 3, an aperture permitting access to a switch actuating arm 90 forming part of an automatic shut off switch assembly as will be subsequently discussed in connection with FIG. 13. A lever arm portion of the float 70 (see FIG. 2) projects through the aperture 69 to engage and operate the switch actuating arm 90, the wall 67 separating the switch arm 90 and the associated switch circuitry from the condensate filled bucket 62 so as to preclude the possibility of any electrical short circuiting due to leaking of condensate and to also preclude direct access to the shut off switch by the user.

Figure 4:
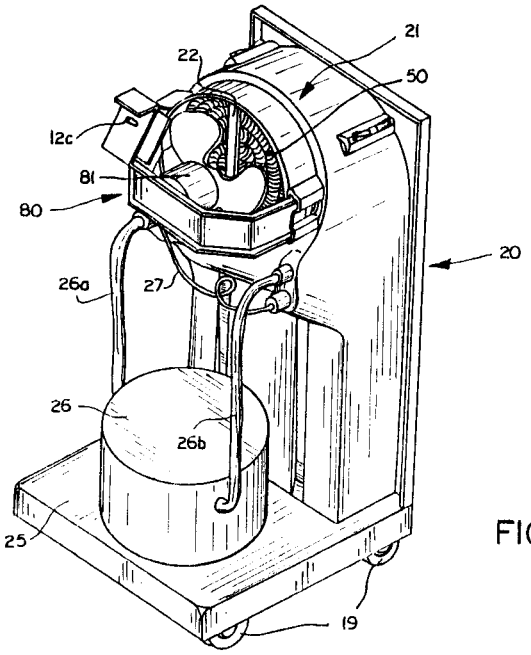
FIG. 4 is a right front perspective view of a dehumidifier in accordance with the present invention wherein its outer case or enclosure, and its condensate collecting bucket, have been removed to illustrate major internal components of the dehumidifier.

In FIG. 4, the front panel 11 and sheet metal housing 14, discussed earlier, have been removed wherein the dehumidifier of the present invention can be seen to include the vertically extending frame member 20 preferably constituted by a one piece, injection molded, plastic member which has at its upper end a cylindrical air flow duct 21 defined by circular wall portions of the frame member 20. The cylindrical duct 21 contains a refrigeration coil subassembly in the form of a condenser/evaporator module to be subsequently illustrated. The frame member 20 is supported in its vertical position at its lower end by being mechanically connected to the rearward end of a horizontally extending base member 25, in the preferred form of a stamped metal plate which is rectangular in shape and is supported at each of its corners by wheels 19 so that the dehumidifier can be easily pushed from one location to another, between rooms of a house for example.

With reference to FIG. 4, contained within the cylindrical duct 21, at an inlet end thereof, is the earlier noted evaporator coil 30 (see FIGS. 2 and 3) and, at the outlet end thereof, a condenser coil 50 (see FIG. 4). A diametrical cross piece or brace 22 is integrally formed as part of the plastic frame member 20 and serves to maintain the position of the condenser within the duct 21 as will be subsequently discussed.

The dehumidifier in accordance with the present invention also includes a fan subassembly or fan module 80 which is mounted adjacent the outlet end of the air flow duct 21 as indicated. The fan module 80 including a motor driven fan 81 which draws air through the duct 21 containing the evaporator coil 30 (see FIG. 3), condenser coil 50, and retaining means to be subsequently discussed. A hermetic motor/compressor refrigeration unit 26, mounted on and supported by the base member 25, provides an output or feed line 26*a* which is connected to one end of the evaporator coil 30, the feed line providing cold refrigerant to the evaporator coil. The other end of the evaporator coil is connected to one end of a capillary tube 27 having its other end connected to one end of the condenser coil 50. The other end of the condenser coil 50 is connected to a return line 26*b* of the motor compressor unit 26. As will be well recognized by those in the art, refrigerant provided by the compressor unit 26 circulates serially through the evaporator coil 30, then the capillary tube 27 (functioning as an expansion valve), and then the condenser coil 50 to provide for the continuous cooling of evaporator coil 30 upon which condensate forms.

Figure 5:
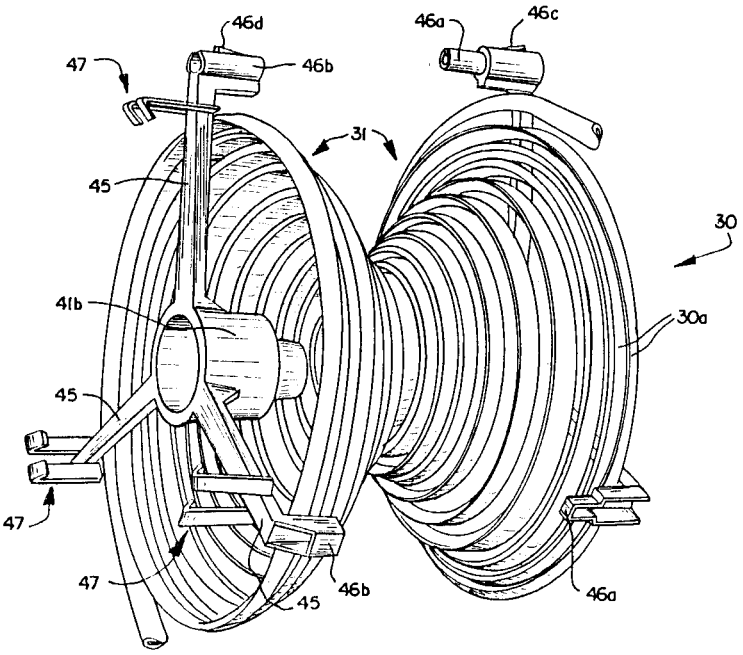
FIG. 5 is a perspective view of an evaporator coil portion of the dehumidifier in an expanded, uncompressed condition wherein it is about to be compressed and contained within a cage structure in accordance with the present invention.

With reference to FIG. 5, the formation of the evaporator coil 30 as part of a condenser/evaporator module or subassembly will now be discussed. Preferably, the evaporator coil 30 is formed of partially flattened metal tubing 30*a* having an oval shaped cross section such material being well known in the art. A continuous length of the tubing 30*a* is spirally wound inwardly and then outwardly about and along a common axis to provide a pair of truncated, cone-shaped, springlike first coil sections 31 having their apex portions abutting each other as illustrated in FIG. 5, one cone-shaped section being inverted relative to the other cone-shaped section. In effect, the sections 31 takes the form of a bed spring and are resilient in nature. After the sections 31 have been formed in accordance with the present invention, they are compressed together to form adjacent disc shaped sections and are then, in their compressed state, held with a retaining means in the preferred form of a cage 40, shown in a disassembled condition in FIG. 5.

Figure 6:
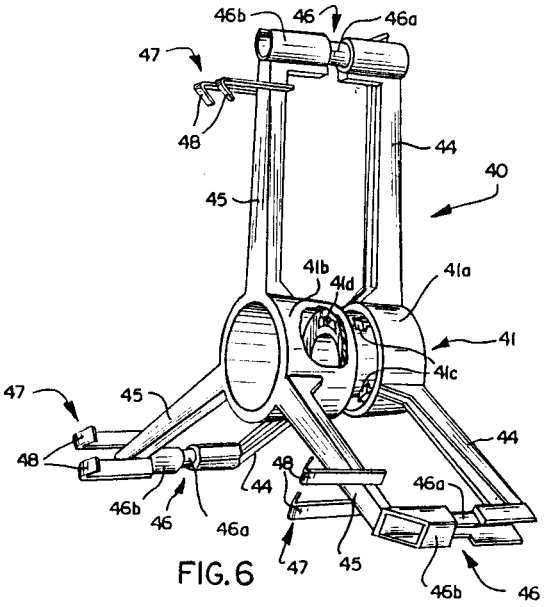
FIG. 6 is a perspective , partially exploded, view of the cage structure illustrated in FIG. 5.

With reference to both FIGS. 5 and 6, the cage 40 is preferably formed in first and second halves from injection molded plastic material exhibiting sufficient mechanical strength and resiliency. The cage 40 includes a central hub portion 41 which extends through the centers of both of the coil sections 31 as illustrated. The hub 41 is comprised of a first part 41*a* from which radially projects in a common plane a first set of spokelike cage fingers 44. In a similar manner a second or remaining portion 41*b* of the hub 41 provides a second set of spokelike cage fingers 45 also radially projecting in a common plane spaced from the plane in which fingers 44 lie. The hub portions 41*a*, 41*b* when interconnected are held together by latching means in a preferred form of a plurality of resilient locking hooks 41*c* provided as integral parts of the hub portion 41*a* as illustrated, the hooks 41*c* being received by and locked into slots 41*d* provided in hub portion 41*b*, the hooks 41*c* and slots 41*d* constituting snap-together latching members. At the distal ends of the sets of spokelike cage fingers 44, 45 cross tie members 46 are provided for interconnecting the ends of the sets of fingers 44, 45. The cross tie members 46 each include a projection 46*a* that is received into associated recess 46*b*. As will be illustrated in greater detail, the projections 46*a* include detent means which lock the projections into position within the recesses 46*b* when the projections 46*a* are snapped into or inserted into the recesses 46*b*. As noted earlier the hub portions 41*a* and 41*b* are connected together by use of the screw 41*c*.

In further accordance with the invention, the second set of spokelike cage fingers 45 provides hooklike members 47 each having a pair of resilient fingers or catches 48, the hooklike members 47 being integrally formed of plastic material with the cage fingers 45. The member 47 snapping over and engaging an outer turn of the earlier discussed condenser coil as will be subsequently illustrated in connection with FIG. 9.

With reference to FIG. 7, the interconnection of cage element 46*a* and 46*b* and the mounting of such cage elements within the air flow duct 21, discussed earlier, is illustrated. The illustrated projection 46*a* is hollow and cylindrical, and includes a reduced diameter front end having a slot as illustrated and a rearward end having a resilient integrally formed latchlike detent 46*c*. The recess portion 46*b* is also provided with a resilient latchlike detent 46d. Part of the air flow duct 21 is defined by a wall portion of the frame member 20 defining a mounting recess 23 (see also FIGS. 9 and 10) which has a slot 24 as illustrated. With further reference to FIG. 6, it can be seen that two of the cross tie members 46 are constituted by the type of structure illustrated in FIG. 7, while the third cross tie member 46, (the lowermost member 46 illustrated in FIG. 6) is of rectangular cross section design wherein the projection 46a is press fitted into the socket or recess portion 46b and held therein. It is to be recognized that while two types of cross members 46 are illustrated, other types could be provided without departing from the scope of the present invention as will become apparent.

With further reference to FIG. 7, it can be seen that the reduced diameter of leftward end of the projection 46a can be inserted into the rightward end of hollow recess 46b wherein the detent 46d will snap downwardly into the slot of the projection 46a and lockably retain it in position within the recess 46b. With the elements 46a and 46b interconnected, they can together be inserted into the recess 23 of the frame member 20 to a point where the resilient detent 46c will snap upwardly into the slot 24 to in effect lock the cage 40 (see FIG. 6) within the air flow duct 21.

Figure 10:
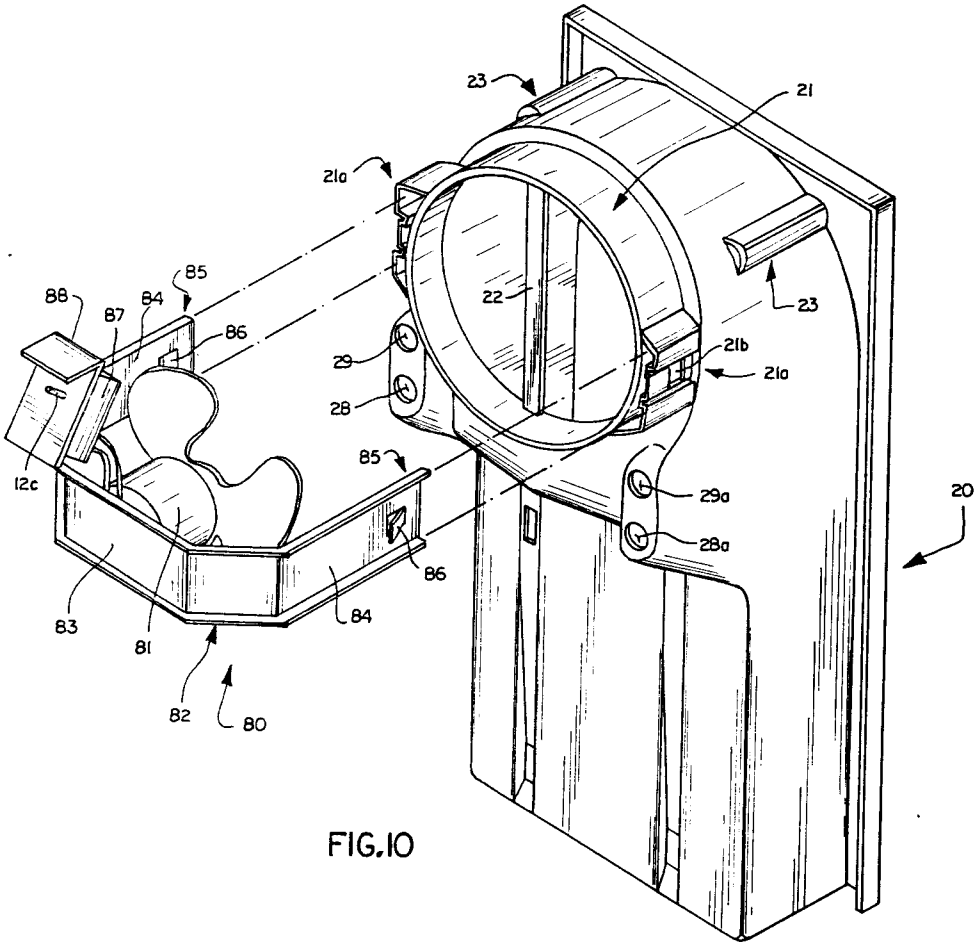
FIG. 10 is a partially exploded right front perspective view of a fan module about to be mounted on the frame of the dehumidifier.

A clearer understanding of the refrigeration coil subassembly and its mounting within the air flow duct 21 of the dehumidifier can be had by reference to FIGS. 8 and 9. With particular reference to FIG. 8, it can be seen that the first coil sections 31 (see FIG. 5) have been compressed within the cage 40 so that sections 31 are generally disc shaped and are held by the cage 40 in adjacent parallel relation to each other. Since the sections 31 are maintained in compression, mechanical vibration of the evaporator coil 30 within the cage 40 is minimized. With further reference to FIG. 8, it can be seen that the condenser coil 50 is preferably formed from a continuous length of finned refrigeration tubing that is spirally wound inwardly and then outwardly about a common axis to provide a pair of adjacent second coil sections. As shown in FIG. 9, when the condenser coil 50 is mounted on the evaporator and cage subassembly shown in FIG. 8, the hooklike members 47 will snap over and grip an outer turn of the condenser coil 50 so that a condenser/evaporator coil module 35 is provided as a subassembly. The module 35 is inserted as the unit into the cylindrical air flow duct 21 providing the mounting recesses 23 as discussed earlier wherein the cage 40 is locked in position within the air flow duct 21, the cage 40 thus functioning as a retaining means engaging both the evaporator coil and the condenser coil so as to hold the coils in position relative to each other, and so as to position and support the coils 30, 50 within the duct. With reference to FIG. 4 and FIG. 10, the diametrical cross piece or brace 22 functions with the cage 40 as a means for compressing between the brace 22 and the cage 40, the condenser coil 50 wherein the compressed condenser coil is less prone to noise generating mechanical vibration in a manner similar to the compressed evaporator coil 30 contained within the cage 40. The cross piece or brace 22 abuts the leftward end of the condenser 50 as viewed in FIG. 9 to establish and maintain the axial position of the condenser-/evaporator module 35 within the cylindrical duct 21. With further reference to FIGS. 8 and 9, one end of evaporator coil constitutes an evaporator coil inlet 52 which passes through an evaporator coil inlet aperture 28 (see FIG. 10) for connection to the earlier discussed feed line 26a (see FIG. 4). In a similar manner the other end of the evaporator tube constitutes an evaporator coil outlet 33 which extends through an evaporator coil outlet aperture 28a provided by the frame member 20 for connection to one end of the capillary tube 27 (see FIG. 4). In a similar manner, one end of the condenser coil 50 constitutes a condenser coil inlet 52 which is connected to the other end of the capillary tube 27 (see FIG. 4). Finally, the other end of the condenser coil 50 constitutes a condenser coil outlet 53 which extends through a condenser coil outlet aperture 29a connected to the return line 26b as discussed earlier in relation to FIG. 4. It can thus be seen that the interconnection points or location of the evaporator coil, condenser coil, capillary tube and feed and return line of the refrigeration compressor are all located externally of the air flow duct 21 which contains the condenser/evaporator module 35. Thus, in accordance with the present invention, the interconnection locations can be easily accessed for leak testing and repair when necessary. It has been found that the use of a molded one piece frame member 20 having an air flow duct 21 into which is inserted the condenser/evapoartor module 35 provides for a very simple, reliable, easily assembled structure that is low in cost.

Figure 11:
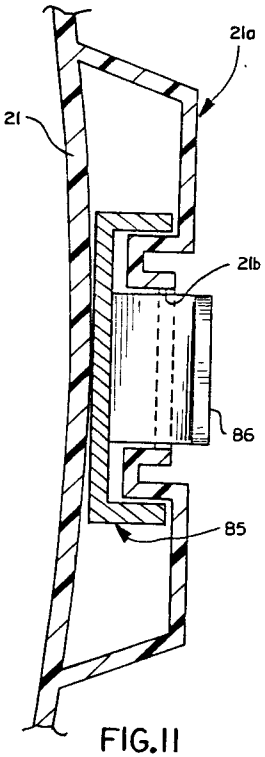
FIG. 11 is a cross section view of the inerconnection structure of a fan module support bracket and a socket portion of the frame.

With reference to FIG. 10, the components of the fan module 80 and its mounting on the frame member 20 will now be discussed in greater detail. The fan module or subassembly 80 includes the earlier noted motor driven fan 81 of conventional design. The module 80 has a U-shaped, metal mounting bracket 82 having a base portion 83 and a pair of opposed parallel legs 84 of equal length, the legs being spaced at their distal ends by a distance approximately equal to the diameter of the cylindrical air duct 21 as illustrated. The distal ends of the legs 84 provide bayonet projection portions 85 each having integrally-formed tablike detents 86. The motor driven fan 81 is mechanically fixed to the base portion 83 of the bracket 82 as illustrated. A conventional dehumidifier control box 87 is also mounted to a control box mounting bracket 88 which in turn is fixed to the fan mounting bracket 82 as illustrated. The control box 87 has a rotatable shaft 12c which extends through the front panel 11 and receives the knob 12a discussed earlier with regard to FIG. 1. The plastic frame member 20 provides, in diametrically opposed relation, a pair of integrally formed sockets 21a, each having a rectangular aperture 21b (only one shown in FIG. 10). As shown in FIG. 10, the bayonet projection portions 85 of the bracket 82 can be inserted or plugged into the sockets 21a until each detent 86 snaps into its slot 21b wherein the bayonet projection portions 85 are locked in position within the sockets 21a, the bracket when mounted on the frame member 20 lying in a generally horizontal plane (see FIG. 4) with the motor driven fan being located at the forward end of the duct 21 to pull air through it, the frame member 20 being the sole means for supporting the fan module 80. The interconnected relationship of the bayonet portions 85 and the associated socket portions 21a of the frame 20 are illustrated in greater detail in FIG. 11 which clearly shows the extension of the tablike projection 86 through the aperture 21b shown most clearly in FIG. 10.

Figure 13:
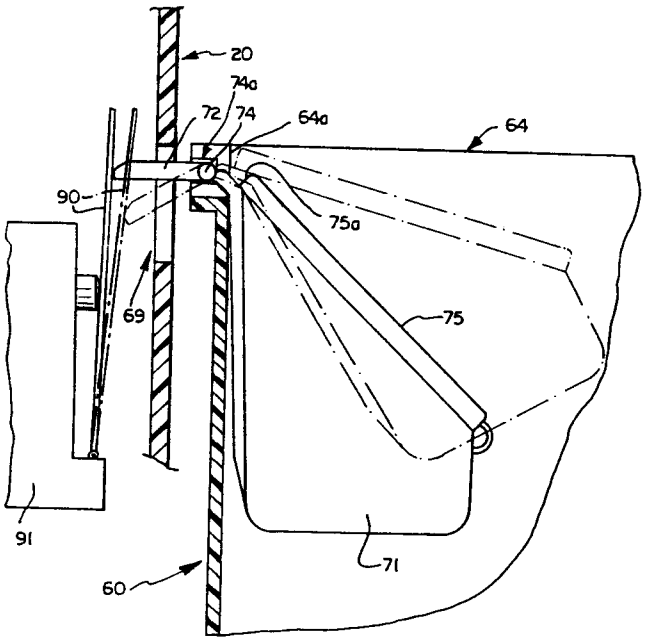
FIG. 13 is a side, cross-sectional view of the float mounted on the bucket with the bucket being mounted on the dehumidifier for actuating an automatic shut off switch to indicate a maximum level of condensate in the collecting bucket.
Figure 12:
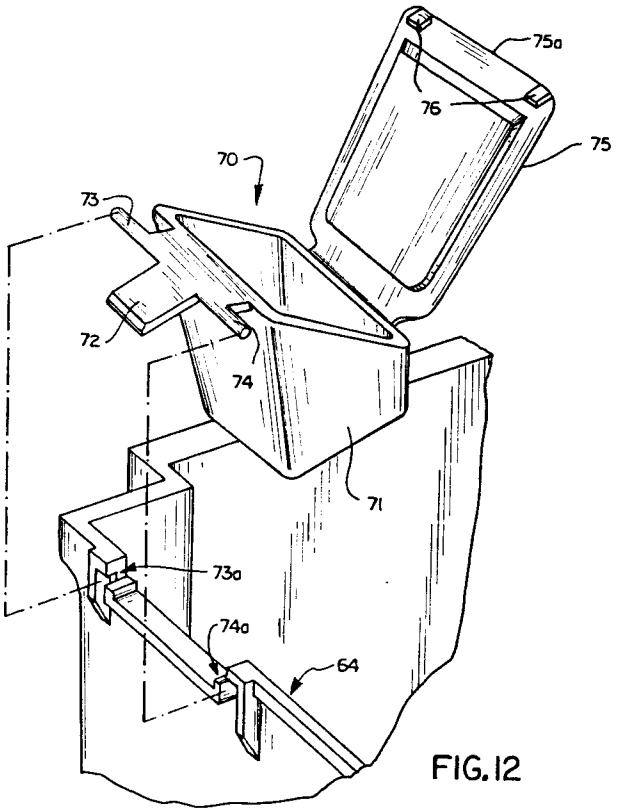
FIG. 12 is a partially exploded, perspective view of a portion of the condensate collecting bucket for supporting the illustrated float.

The structure and operation of the earlier noted float 70 will now be more fully discussed with regard to FIGS. 12 and 13. The float 70 can be seen to include a hollow cuplike float portion 71 that is pivotally supported on a notched portion of the rim 64 of the bucket 60, so that the notched portion acts as a fulcrum point adjacent to a normally open electrical switch 90 of conventional design as illustrated most clearly in FIG. 13. A lever arm 72 emanates from the fulcrum point provided by the notched rim portion of the bucket, the lever arm extending toward and engaging the actuating element 90 of the switch 91 wherein, upon a predetermined upward or downward movement of the float portion 71, a concurrent but opposite downward and upward movement of the distal end of the lever arm 72 will occur to in turn cause the electrical switch 91 to be actuated so as to change from one conducting condition to another to either enable or disable the operation of the dehumidifier.

With particular reference to FIG. 12, the float portion 71 and the lever arm portion 72 are joined together at a hinge pin section providing a first hinge pin end 73 and a second hinge pin end 74, both ends 73, 74 lying along the axis of rotation of the float 70 as illustrated. The hinge pin end 73 is received in a bushing support portion 73*a* provided by the rim 64 while the second hinge pin end 74 is received in a similar manner by a second bushing support portion 74*a*. By appropriate dimensioning of the lever arm 72 relative to the hinge pin ends 73, 74 relative to the float portion 71, the hinge pin ends 73, 74 can be freely moved into and out of the associated bushing support portions 73*a*, 74*a* when a lid 75 hinged to the float portion 71 as illustrated is in a raised position. To lockably mount the float 70 in position on the bucket rim 64 is illustrated in FIG. 13, the hinge pin ends 73, 74 are positioned within the bushing support portions 73*a*, 74*a*, and then the lid 75 is closed as illustrated in FIG. 13 and lockably held in a closed position by a pair of resilient tablike locks 76. With particular reference to FIG. 13, it can be seen that upon upward movement of the float portion 71, caused for example by a rising level of liquid condensate in the bucket 60, the lever arm 72 extending through the aperture 69 as discussed earlier with regard to FIG. 3 will move downwardly, as illustrated in phantom, until the normally open switch 91 changes to its normally open circuited condition, so as to disable operation of the dehumidifier. It can also be seen that whenever the bucket 60 with its float 70 is removed from the dehumidifier (see FIG. 3), the dehumidifier can not operate. When the condensate is removed from the bucket 60 and the bucket 60 has been remounted on the dehumidifier, the float portion 71 will have returned by gravity to its normal lowered position illustrated in FIG. 13 wherein the horizontally extending lever arm 72 will hold the switch 91 in a closed condition to permit operation of the dehumidifier.

With further reference to FIG. 13, it can also be seen that with the cover 75 in a closed position, its forward edge 75*a* will engage a stop portion 64*a* of the rim 64 to interfere with movement of the hinge pin ends 73, 74 (see FIG. 12) out of their position within the bushing support portions 73*a*, 74. Thus, when the bucket is removed from the dehumidifier for emptying, the float 70 will not fall off the rim of the bucket when it is inverted to pour out the condensate. If it is desired, for cleaning purposes, to remove the float from its pivotally mounted position on the rim 64 of the bucket 60, the float lid 75 can be opened to its position as illustrated in FIG. 12 to allow for further upward vertical movement of the float so that the hinge ping ends 73, 74 can be slid out of their position within the bushing support portions 73*a*, 74. The float elements 71 through 76 can be simultaneously formed from injection molded plastic material to provide a one piece float 70 at very low cost.

From the foregoing it can be seen that a dehumidifier having a minimum number of simple components has been provided, and that these components when assembled into plurality of modules or subassemblies can in turn be easily assembled into a dehumidifier having earlier noted characteristics that will provide for low cost and high reliability.

Although the preferred embodiment of this invention has been shown and described, it should be understood that various modifications and rearrangements of the parts may be resorted to without departing from the scope of the invention as disclosed and claimed herein.

What is claimed is:

1. A portable dehumidifier comprising:

a horizontal base member;

a frame supported by the base member, the frame providing an air flow duct through which air can pass;

a motor-driven fan for inducing the flow of air through the duct;

a condenser/evaporator module having a condenser coil, an evaporator coil, and a retaining means engaging both of the coils to hold the coils in position relative to each other, the retaining means including mounting portions engageable with wall portions of the frame defining said duct, said retaining means positioning and supporting said module within said duct; and a hermetic refrigeration compressor providing refrigerant to the condenser/evaporator module:

said frame being a one-piece molded plastic member including, as an integral portion thereof, a crosspiece extending generally diametrically across said duct, said module, when mounted in said duct, abutting said crosspiece, to maintain said module in position within said duct said module including a spirally wound springlike condenser coil that is generally compressed between said crosspiece and remaining portions of said module to minimize mechanical vibration of said condenser coil within said duct.

2. A portable dehumidifier comprising:

a horizontal base member;

a vertically extending one piece frame having a lower end fixed to and supported by the base member, and an upper end providing a horizontal air flow duct through which dehumidified air can pass;

a fan module, including a motor-driven fan for inducing the flow of dehumidified air through the duct, the fan module being fixed to and solely supported by the upper end of the frame in spaced relation from one end of said air flow duct;

a condenser/evaporator module fixed to and supported by the upper end of the frame, the condenser/evaporator module being located within the duct, the condenser/evaporator module including retaining means having mounting portions engageable with wall portions of the frame defining the duct, said retaining means positioning and supporting said module in position within said duct; and a hermetic refrigeration compressor fixed to and supported by the base member, the compresser providing refrigerant to the condenser/evaporator module.

3. A portable dehumidifer comprising:

a horizontal base member;

a vertically extending frame having a lower end fixed to and supported by the base member, and an upper end providing an air flow duct through which dehumidified air can pass;

a fan module, including a motor-driven fan for inducing the flow of dehumified air through the duct, the fan module being fixed to and supported by the frame;

a condenser/evaporator module fixed to and supported by the frame, the condenser/evaporator module being located within the duct, the condenser/evaporator module including retaining means having mounting portions engageable with wall portions of the frame defining the duct, said retaining means positioning and supporting said module in position within said duct; and a hermetic refrigeration compressor fixed to and supported by the base member, the compressor providing refrigerant to the condenser/evaporator module:

said frame being a one-piece, molded plastic member, and said fan module including a bracket carrying said motor driven fan, the bracket being fixed to the frame by bayonet projection portions of the bracket lockably inserted into socket portions of the frame, the bracket holding the motor-driven fan in spaced relation from the frame at one end of the duct.

4. A dehumidifier according to claim 3, wherein said bracket is U-shaped, and has a base portion and a pair of opposed legs, said motor-driven fan being located at and mounted to the base portion of the bracket, the distal ends of the legs providing the said bayonet projection portions, the legs and base portion lying in a horizontal plane when said fan module is mounted to said vertically extending frame.

5. A dehumidifier according to claim 4, wherein the distance between said distal ends of the legs is approximately equal to the diameter of the duct, said socket portions of the frame being diametrically opposed to either side of said one end of said duct to receive said bayonet projection portions.

6. A dehumidifier according to claim 4, wherein said bayonet projection portions and said socket portions are the sole means for mounting said fan module to said frame, and said frame is the sole support means for said fan module.

7. A dehumidifier according to claim 6, including a user-actuated control for regulating the operation of the dehumidifier, said control being mounted on and fixed to the said bracket.

8. A refrigeration coil module for use in an appliance such as a dehumidifier comprising:

a continuous length of refrigeration tubing spirally wound inwardly and then outwardly about and along a common axis to provide a pair of truncated, cone-shaped, springlike first coil sections with their apex portions abutting each other, one coneshaped section being inverted relative to the other coneshaped section; and a cage for containing and maintaining under compression said springlike coil sections, wherein said coil sections when compressed in said cage are generally disc-shaped and are held by said cage in adjacent parallel relation to each other, said spirally wound tubing being held in compression by and within said cage to minimize mechanical vibration of said coil sections within said cage.

9. A refrigeration coil module for use in an appliance such as a dehumidifier comprising:

a continuous length of refrigeration tubing spirally wound inwardly and then outwardly about and along a common axis to provide a pair of truncated, cone-shaped, springlike first coil sections with their apex portions abutting each other, one coneshaped section being inverted relative to the other coneshaped section; and a cage for containing and maintaining under compression said spring-like coil sections, wherein said coil sections when compressed in said cage are generally disc-shaped and are held by said cage in adjacent parallel relation to each other, said spirally wound tubing being held in compression by and within said cage to minimize mechanical vibration of said coil sections within said cage, said cage including a hub portion extending through the centers of both of said coil sections, a first set of spokelike cage fingers extending radially from said hub portion, and a second set of spokelike cage fingers also extending radially from said hub portion, said sets being spaced from each other, each set lying in different planes, said coil sections being located and contained between said first and second sets of cage fingers.

10. A refrigeration coil module according to claim 9, including cross tie members interconnecting the distal ends of the first set of cage fingers with the distal ends of the second set of cage fingers.

11. A refrigeration coil module according to claim 10, wherein said cross tie members include means for mounting said cage and coil sections contained therein within a duct through which air can flow.

12. A refrigeration module according to claim 10, wherein said cage is molded plastic and includes a first half providing part of said hub portion, said first set of cage fingers, and parts of said cross tie members, said cage further including a second half providing a remaining part of said hub portion, said second set of cage fingers, and remaining parts of said cross tie members, said first and second halves being joined together to provide said cage.

13. A refrigeration module according to claim 12, wherein said part of said hub portion and said remaining part of said hub portion are joined together to provide said cage.

14. A refrigeration module according to claim 13, wherein said part and remaining part of the hub portion are joined and fastened together by snap-together latching members constituting integral portions of said hub portion.

15. A refrigeration module according to claim 12, wherein said parts of said cross tie members and said remaining parts of said cross tie members are joined together to form said cage.

16. A refrigeration module according to claim 15, wherein said parts of said cross tie members provide cross tie recesses, and said remaining parts of said cross tie members provide cross tie projections, said cross tie projections being inserted into and lockably engaging said cross tie recesses to mechanically join said parts and remaining parts so as to provide the cross tie members of the cage.

17. A refrigeration module according to claim 16, wherein said cross tie projections include resilient detent means for releasably locking said projections into said cross tie recesses.

18. A refrigeration coil module for use in an appliance such as a dehumidifier comprising:

a first continuous length of refrigeration tubing spirally wound inwardly and then outwardly about a common axis to provide a pair of adjacent first coil sections;

a cage for containing said first length of spirally wound refrigeration tubing, said cage including a plurality of hooklike resilient projections; and a second continuous length of refrigeration tubing spirally wound inwardly and then outwardly about said common axis to provide a pair of adjacent second coil sections, the second length of spirally wound tubing being engaged and held by said hooklike resilient projections of the cage to hold the first and second lengths of spirally wound tubing in adjacent relationship to each other.

19. A refrigeration coil module according to claim 18, wherein a capillary tube member can be series connected in fluidtight relation between one end of said first length of refrigeration tubing and one end of said second length of refrigeration tubing outside of said capillary tube member functioning as an expansion valve, said first coil sections constituting an evaporator coil, said second coil sections constituting a condenser coil.

20. A refrigeration coil module according to claim 18, wherein said hooklike resilient projections each include a pair of fingers having distal end portions that snap over and engage an outer turn of said second length of spirally wound tubing.

21. A portable dehumidifier having a removable plastic bucket for collecting liquid condensate generated by the dehumidifier, said bucket having a rim, the dehumidifier including an electrical switch located apart from the bucket at a position adjacent to said rim, the switch deactivating the dehumidifier to preclude overfilling said bucket, an improved float for sensing a rising level of condensate in the bucket and in response thereto, at a predetermined maximum condensate level, activating said switch to deactivate the dehumidifier, said float comprising:

a float portion pivotally supported on a portion of the rim of the bucket, said rim portion acting as a fulcrum point, said rim portion being adjacent to said electrical switch; and a lever arm emanating from said fulcrum point, said lever arm extending toward and engaging an actuating element of said switch, wherein predetermined upward and downward movements of the float portion causes concurrent but opposite downward and upward movements of the distal end of the lever arm to in turn cause the electrical switch to be actuated so as to change from one conducting condition to another conducting condition, said float portion being gravity biased downwardly and being bouyant in liquid condensate collected in said bucket, said electrical switch being of the normally open type, said distal end of the lever arm holding the switch in a closed condition when the float portion is at or below a predetermined vertical position, said switch moving to its normally open position when said bouyant float portion is moved upwardly by the action of a rising level of condensate in said bucket wherein said switch in its normally open position precludes operation of the dehumidifer said switch being in an open position when said bucket with said float mounted thereon is removed from said dehumidifier.

22. A portable dehumidifier having a removable plastic bucket for collecting liquid condensate generated by the dehumidifier, said bucket having a rim, the dehumidifier including an electrical switch located apart from the bucket at a position adjacent to said rim, the switch deactivating the dehumidifier to preclude overfilling said bucket, an improved float for sensing a rising level of condensate in the bucket and in response thereto, at a predetermined maximum condensate level, activating said switch to deactivate the dehumidifier, said float comprising:

a float portion pivotally supported on a portion of the rim of the bucket, said rim portion acting as a fulcrum point, said rim portion being adjacent to said electrical switch; and a lever arm amanating from said fulcrum point, said lever arm extending toward and engaging an actuating element of said switch, wherein predetermined upward and downward movements of the float portion causes concurrent but opposite downward and upward movement of the distal end of the lever arm to in turn cause the electrical switch to be actuated so as to change from one conducting condition to another conducting condition, said float portion being gravity biased downwardly and being bouyant in liquid condensate collected in said bucket, said electrical switch being of the normally open type, said distal end of the lever arm holding the switch in a closed condition when the float portion is at or below a predetermined vertical position, said switch moving to its normally open position when said bouyant float portion is moved upwardly by the action of a rising level of condensate in said bucket wherein said switch in its normally open position precludes operation of the dehumidifer said float portion and said lever arm being joined to a hinge pin integrally formed of plastic material with said float portion and said lever arm.

23. An improved float according to claim 22, wherein said hinge pin has first and second ends journalled for pivoting motion by said rim portion, said ends being freely movable from their journalled position on said rim portion.

24. An improved float according to claim 23, including mechanical means to retain the hinge pin ends in their journalled position on said rim portion, said mechanical means being carried by the said float portion.

25. An improved float according to claim 24, wherein said float portion is hollow and includes a hinged lid having a lip portion constituting said mechanical means that, when said lid is closed, is engageable with said rim portion to limit the free movement of said hinge pin out of its journalled position thereby retaining the float in position on said rim portion of the said rim portion of the bucket so that the float will not fall off of the bucket when it is removed from the dehumidifier.

* * * * *